US006825621B2

(12) United States Patent
Song et al.

(10) Patent No.: US 6,825,621 B2
(45) Date of Patent: Nov. 30, 2004

(54) ELECTRON GUN FOR COLOR CATHODE RAY TUBE

(75) Inventors: Yong-Seok Song, Ulsan (KR); Sung-Jun An, Suwon (KR); Do-Hyoung Kim, Ulsan (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 10/032,481

(22) Filed: Jan. 2, 2002

(65) Prior Publication Data

US 2002/0101161 A1 Aug. 1, 2002

(30) Foreign Application Priority Data

Jan. 2, 2001 (KR) ..... 26/2001

(51) Int. Cl.[7] ..... H01J 29/62; H01J 29/50

(52) U.S. Cl. ..... 315/368.16; 315/5.34; 313/414; 313/415

(58) Field of Search ..... 315/5.24, 5.25, 315/5.27, 5.29, 5.34, 368.11, 368.16, 368.15, 382; 313/414, 412, 413, 428, 415

(56) References Cited

U.S. PATENT DOCUMENTS 4,374,341 A * 2/1983 Say ..... 313/414
5,061,881 A * 10/1991 Suzuki et al. ..... 315/382
5,128,586 A 7/1992 Ashizaki et al. ..... 313/414
5,350,967 A * 9/1994 Chen ..... 313/413
5,600,201 A * 2/1997 Yun et al. ..... 313/414
5,760,550 A 6/1998 Sukeno et al. ..... 315/382
6,184,617 B1 * 2/2001 Choi ..... 313/447
6,479,927 B1 * 11/2002 Ju ..... 313/414

* cited by examiner

*Primary Examiner*—Tuyet Thi Vo
(74) *Attorney, Agent, or Firm*—Robert E. Bushnell, Esq.

(57) ABSTRACT

An electron gun for a color cathode ray tube includes a cathode which is a source for emitting an electron beam, a control electrode, through which the electron beam emitted from the cathode passes, having first electron beam passing holes each including a first vertically elongated indented portion formed at an output side surface of the control electrode and a first electron beam passing hole portion formed in the first indented portion, a screen electrode installed adjacent to the control electrode and having second electron beam passing holes formed in the screen electrode, a plurality of focusing electrodes for forming a plurality of quadrupole lenses, sequentially installed from the screen electrode and respectively having electron beam passing holes having a predetermined shape.

20 Claims, 4 Drawing Sheets

ELECTRON GUN FOR COLOR CATHODE RAY TUBE

CLAIM OF PRIORITY

This application makes reference to, incorporates the same herein, and claims all benefits accruing under 35 U.S.C. § 119 from an application for ELECTRON GUN FOR COLOR CATHODE RAY TUBE earlier filed in the Korean Industrial Property Office on 2 Jan. 2001, and there duly assigned Ser. No. 26/2001 by that Office.

BACKGROUND OF THE INVENTION

1. Technical Field

The present invention relates to an electron gun for a color cathode ray tube (CRT), and more particularly, to an electron gun for a color cathode ray tube in which the structure of an electrode for forming an asymmetrical beam forming lens is improved.

2. Related Art

An electron gun used in a large screen color cathode ray tube needs to be able to stably generate a low current electron beam and a high current electron beam. A cathode ray tube can adopt an in-line type electron gun and a deflection yoke of a self-converging type having a pincushion type deflection magnetic field and a barrel type deflection magnetic field. The deflection magnetic fields of the deflection yoke vertically over-focus and horizontally under-focus the electron beam so that a focus separation phenomenon occurs. The electron beam spot deformed as above becomes asymmetrical when being deflected toward the periphery of a screen. Also, in the in-line type electron gun, focus is not uniform due to a change in intensity of an electron lens generated by a change in a focus voltage.

To prevent the above deterioration of the focus of an electron beam landing on a fluorescent film, a method can be suggested in which distortion due to the irregular magnetic field of a deflection yoke is compensated for by forming the profile of an electron beam emitted from the electron gun to be vertically elongated.

U.S. Pat. No. 5,128,586, issued to Ashizaki et al., entitled COLOR CATHODE RAY TUBE GUN HAVING CONTROL GRID OF VARYING THICKNESS, discloses an electron gun emitting an electron beam having the vertically elongated profile which lands on the periphery of a screen to compensate for distortion of the electron beam due to the irregular magnetic field of a deflection yoke.

In an electron gun disclosed in U.S. Pat. No. 5,128,586, an electron beam passing hole is formed by penetrating an indented portion having a horizontally elongated shape at the side to which an electron beam is input and an indented portion having a vertically elongated shape at the side from which the electron beam is output. In the electron gun having the above control electrode, distortion of the electron beam at the periphery of a screen is compensated for by moving the position of a crossover point in the vertical direction rather than in the horizontal direction toward a screen. However, since the diameter of a vertical electron beam passing through the rectangular electron beam passing hole which is penetrated by the horizontally elongated and vertically elongated indented portions is small, the control electrode interferes with a mask having a function of color selection of the electron beam during scanning so that moiré of an image occurs.

U.S. Pat. No. 5,760,550, issued to Sukeno et al., entitled COLOR PICTURE TUBE, discloses a color cathode ray tube having an electron gun in which an electron beam passing hole of a control electrode is formed to be non-circular.

While U.S. Pat. No. 5,128,586 and U.S. Pat. No. 5,760,550 provide advantages, they appear to fail to adequately provide an efficiently and conveniently improved electron gun.

SUMMARY OF THE INVENTION

To solve the above-described problems and others, it is an object of the present invention to provide an electron gun for a color cathode ray tube (CRT) which makes the strength of an electron lens different in the horizontal direction and the vertical direction at the triode portion, so that defocusing by the deflection yoke is minimized, and moiré of the image is prevented.

To solve the above-described problems and others, it is a further object of the present invention to provide an electron gun for a color cathode ray tube which makes the strength of an electron lens different in the horizontal direction and the vertical direction at the triode portion, so that the horizontal resolution of an image can be improved and a vertical focus property of the image can be improved.

To achieve the above objects and others, there is provided an electron gun for a color cathode ray tube which comprises a cathode which is a source for emitting an electron beam, a control electrode, through which the electron beam emitted from the cathode passes, having first electron beam passing holes each including a first vertically elongated indented portion formed at an output side surface of the control electrode and a first electron beam passing hole portion formed in the first indented portion, a screen electrode installed adjacent to the control electrode and having second electron beam passing holes formed in the screen electrode, and focusing electrodes sequentially installed from the screen electrode.

It is preferred in the present invention that the first electron beam passing hole portion formed in the first indented portion has a circular or rectangular shape and that the second electron beam passing hole portion formed in the screen electrode has a circular or vertically elongate rectangular shape.

Alternatively, to achieve the above objects and others, there is provided an electron gun for a color cathode ray tube which comprises a cathode which is a source for emitting an electron beam, a control electrode, through which the electron beam emitted from the cathode passes, having first electron beam passing holes each including a first vertically elongated indented portion formed at an output side surface of the control electrode and a first electron beam passing hole portion formed in the first indented portion, a screen electrode installed adjacent to the control electrode and having second electron beam passing holes formed in the screen electrode, a plurality of focusing electrodes for forming a plurality of quadrupole lenses, sequentially installed from the screen electrode and respectively having electron beam passing holes having a predetermined shape.

Alternatively, to achieve the above objects and others, there is provided an electron gun sack for a color cathode ray tube which comprises a cathode which is a source for emitting an electron beam, a control electrode, through which the electron beam emitted from the cathode passes, having first electron beam passing holes each including a first vertically elongated indented portion formed at an output side surface of the control electrode and a first electron beam passing hole portion formed in the first indented portion, a screen electrode installed adjacent to the control electrode and having second electron beam passing holes formed in the screen electrode, a plurality of first, second, and third focusing electrodes respectively having electron beam passing holes having a predetermined shape, a fourth focusing electrode installed adjacent to the third focusing electrode, for forming a first quadrupole lens, a fifth focusing electrode installed adjacent to the fourth focusing electrode, for forming a second quadrupole lens, and a final acceleration electrode installed adjacent to the fifth focusing electrode, for forming a main lens.

It is preferred in the present invention that vertically elongated electron beam passing holes are formed at an output side surface of each of the third and fourth focusing electrodes, horizontally elongated electron beam passing holes are formed at an input side surface of each of the fourth and fifth focusing electrodes, a constant voltage is applied to the screen electrode and the second focusing electrode, a focusing voltage higher than the constant voltage is applied to the first focusing electrode and the fourth focusing electrode, and a dynamic focusing voltage using the focusing voltage as a base voltage is applied to the third and fifth focusing electrodes.

To achieve these and other objects in accordance with the principles of the present invention, as embodied and broadly described, the present invention provides an electron gun for a color cathode ray tube, the gun comprising: a cathode emitting an electron beam; a control electrode having first hole regions, each one of the first hole regions including a first vertically elongated indented portion formed at an output side surface of said control electrode and including a first hole portion formed in the first indented portion, the electron beam passing through said control electrode; a screen electrode being installed adjacent to said control electrode, said screen electrode having second hole regions; and a plurality of focusing electrodes being sequentially installed from said screen electrode.

To achieve these and other objects in accordance with the principles of the present invention, as embodied and broadly described, the present invention provides an electron gun for a color cathode ray tube, the gun comprising: a cathode emitting an electron beam; a control electrode having first hole regions, each one of the first hole regions including a first vertically elongated indented portion formed at an output side surface of said control electrode and including a first hole portion formed in the first indented portion, the electron beam passing through said control electrode; a screen electrode being installed adjacent to said control electrode, said screen electrode having second hole regions; and a plurality of focusing electrodes forming a plurality of quadrupole lenses, said focusing electrodes being sequentially installed from said screen electrode and respectively forming electron beam passing holes having a predetermined shape.

To achieve these and other objects in accordance with the principles of the present invention, as embodied and broadly described, the present invention provides a method, comprising: passing an electron beam through first hole regions of a control electrode, each one of the first hole regions including a first vertically elongated indented portion formed at an output side surface of said control electrode and including a first hole portion formed in the first indented portion, the electron beam passing through said control electrode; passing the electron beam through second hole regions of a screen electrode; and passing the electron beam through a plurality of focusing electrodes sequentially installed from said screen electrode.

To achieve these and other objects in accordance with the principles of the present invention, as embodied and broadly described, the present invention provides a method, comprising: passing an electron beam through first hole regions of a control electrode, each one of the first hole regions including a first vertically elongated indented portion formed at an output side surface of said control electrode and including a first hole portion formed in the first indented portion, the electron beam passing through said control electrode; passing the electron beam through second hole regions of a screen electrode; and passing the electron beam through a plurality of focusing electrodes that form a plurality of quadrupole lenses, said focusing electrodes respectively forming electron beam passing holes having a predetermined shape.

To achieve these and other objects in accordance with the principles of the present invention, as embodied and broadly described, the present invention provides a computer storage medium having stored thereon a set of instructions implementing a method, said set of instructions comprising one or more instructions for: passing an electron beam through first hole regions of a control electrode, each one of the first bole regions including a first vertically elongated indented portion formed at an output side surface of said control electrode and including a first hole portion formed in the first indented portion, the electron beam passing through said control electrode; passing the electron beam through second bole regions of a screen electrode; and passing the electron beam through a plurality of focusing electrodes that form a plurality of quadrupole lenses, said focusing electrodes respectively forming electron beam passing holes having a predetermined shape.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE INVENTION

While the present invention will be described more fully hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Illustrative embodiments of the invention are described below. In the interest of clarity, not all features of an actual implementation are described. In the following description, well-known functions or constructions are not described in detail since they would obscure the invention in unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure. Additionally, the features of the embodiments disclosed can be combined to form an electron gun, in accordance with the principles of the present invention.

The scope of this disclosure includes a computer storage medium having stored thereon a set of instructions implementing a method in accordance with the principles of the present invention. For example, the present invention provides a computer storage medium having stored thereon a set of instructions implementing a method, said set of instructions comprising one or more instructions for: passing an electron beam through first hole regions of a control electrode, each one of the first hole regions including a first vertically elongated indented portion formed at an output side surface of said control electrode and including a first hole portion formed in the first indented portion, the electron beam passing through said control electrode; passing the electron beam through second hole regions of a screen electrode; and passing the electron beam through a plurality of focusing electrodes that form a plurality of quadrupole lenses, said focusing electrodes respectively forming electron beam passing holes having a predetermined shape.

Figure 1:
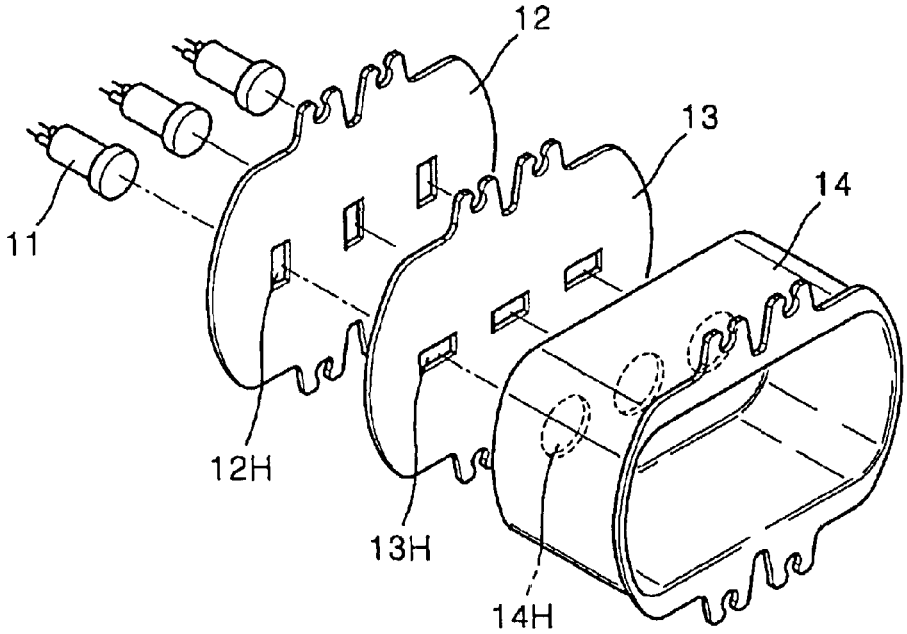
FIG. 1 (PRIOR ART)
FIG. 1 is an exploded perspective view showing an electron gun for a cathode ray tube.

FIG. 1 is an exploded perspective view showing an electron gun for a cathode ray tube (CRT). As shown in the drawing, an electron gun includes a cathode 1, a control electrode 12, and a screen electrode 13 which form a triode portion, and focusing electrodes 14 forming a main lens and an auxiliary lens. Vertically elongated electron beam passing holes 12H are formed at the control electrode 13. Horizontally elongated electron beam passing holes 13H are formed the screen electrode 13 facing the control electrode 12. Circular electron beam passing holes 14H are formed at the focusing electrode 14 facing an output side surface of the screen electrode 13.

In the color cathode ray tube having the structure shown in FIG. 1, an incident angle of the main lens formed by the focusing electrode 14 is reduced by the vertically elongated electron beam passing holes 12H formed by the control electrode 11 and the horizontally elongated electron beam passing holes 13H formed by the screen electrode 12. Thus, dispersion of an image formed by an electron beam spot landing on the periphery of a screen due to the vertical deflection magnetic field of the deflection yoke is minimized and a uniform vertical focus is achieved.

Nevertheless, the above electron gun shows a limit to a very large or perfect flat screen surface. Also, a spot of an electron beam sensitively changes with respect to the amount of change in current according to the level of a video signal. Thus, as current increases, the diameter of a vertical beam of the electron beam increases drastically so that a focus property is deteriorated. Also, in the case of an electron gun, for a low current in which the density of current of the electron beam is lowered, the diameter of the electron beam decreases so that moiré occurs with respect to a low brightness.

Figure 2:
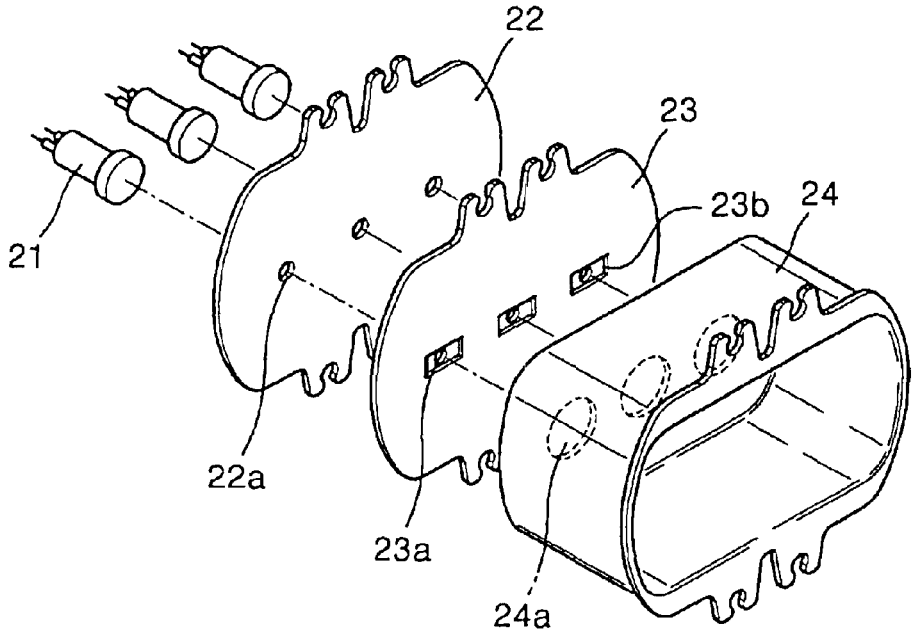
FIG. 2 (PRIOR ART)
FIG. 2 is an exploded perspective view showing another electron gun for a cathode ray tube.

FIG. 2 is an exploded perspective view showing another electron gun for a cathode ray tube. Referring to the drawing, electron beam passing holes 22*a* and 24*a* of a control electrode 22 and a focusing electrode 24 are formed to be circular. Circular electron beam passing holes 23*a* are formed at the screen electrode 23. A horizontally elongated indented portion 23*b* is formed at the edge of each of the electron beam passing holes 23*a* at the output side surface of the screen electrode 23. In the above electron gun, a focusing force of a focusing region of a pre-focus lens formed between the screen electrode 13 and the focusing lens 14 is weakened in the horizontal direction and is strengthened in the vertical direction, so that resolution at the central portion and the periphery of a screen is improved. Nevertheless, the adjustment of the crossover point of the electron beam is not easy.

In a color cathode ray tube, an electron gun installed at a neck portion of a cathode ray tube emits an electron beam to excite a fluorescent film. The electron gun includes a cathode, a control electrode, and a screen electrode which form a triode portion, a plurality of focusing electrodes and a final acceleration electrode for forming a main lens and an auxiliary lens.

Figure 3:
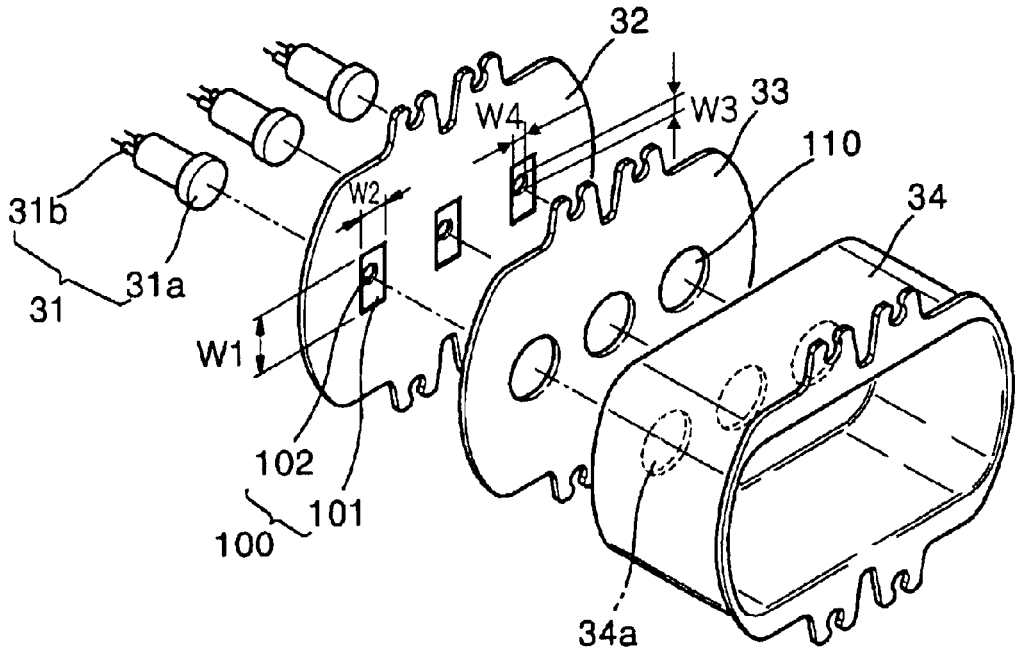
FIG. 3 is an exploded perspective view showing a first preferred embodiment of an electron gun for a cathode ray tube, in accordance with the principles of the present invention.
Figure 4:
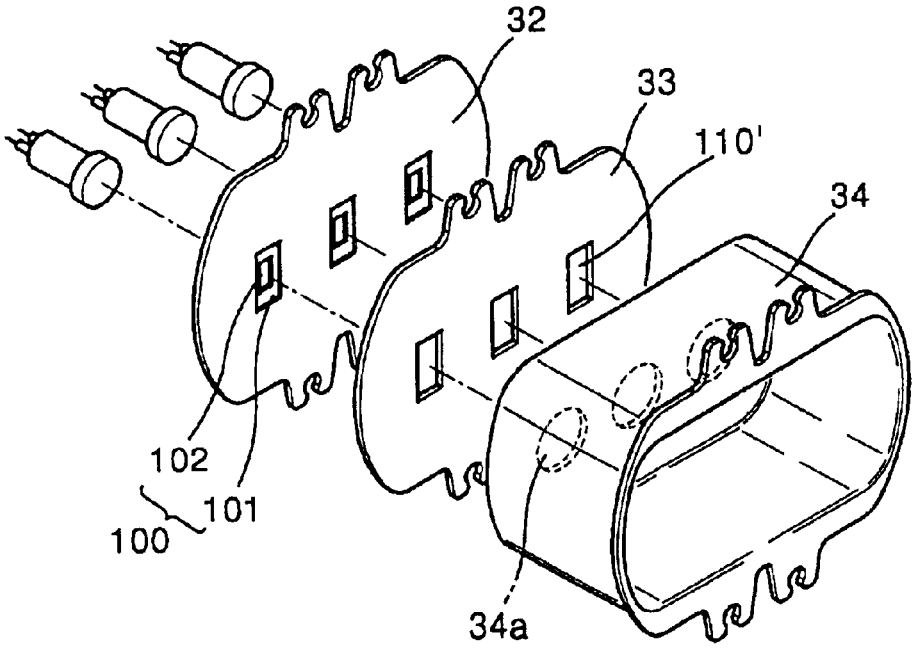
FIG. 4 is an exploded perspective view showing a second preferred embodiment of an electron gun for a cathode ray tube, in accordance with the principles of the present invention.
Figure 5:
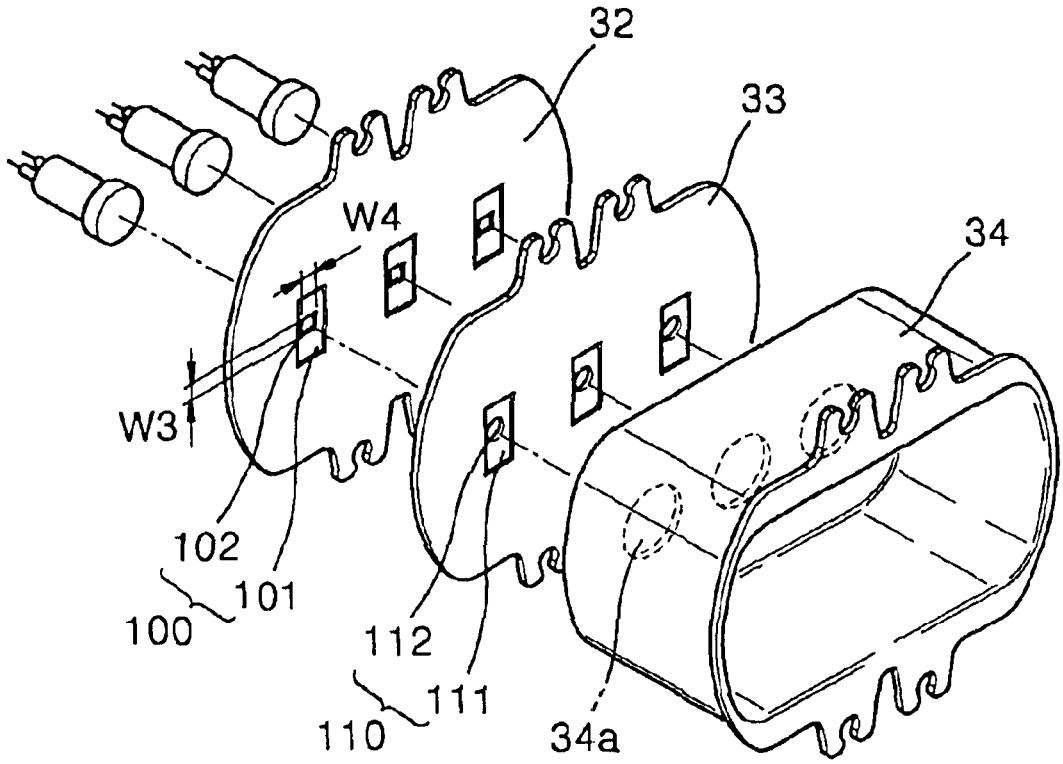
FIG. 5 is an exploded perspective view showing a third preferred embodiment of an electron gun for a cathode ray tube, in accordance with the principles of the present invention.

FIG. 3 is an exploded perspective view showing a first preferred embodiment of an electron gun for a cathode ray tube, in accordance with the principles of the present invention. FIG. 4 is an exploded perspective view showing a second preferred embodiment of an electron gun for a cathode ray tube, in accordance with the principles of the present invention. FIG. 5 is an exploded perspective view showing a third preferred embodiment of an electron guns for a cathode ray tube, in accordance with the principles of the present invention.

A preferred embodiment of the triode portion for emitting an electron beam and forming a point of an object in an electron gun is shown in FIG. 3. As shown in the drawing, a cathode 31 forming the triode portion includes an electron emission portion 31*a* where an electron emission material is dipped or coated, and a heater 31*b* for heating the electron emission portion 31*a*. The electron emission portion 31*a* can be supported by a base metal (not shown) which is supported by a sleeve (not shown) installed inside and the electron emission portion 31*a* can be directly heated by the heater 31*b*.

A first electron beam passing hole 100 is formed at a position corresponding to the cathode 31 at the control electrode 32 installed adjacent to the cathode 31. The first electron beam passing hole 100 includes a vertically elongated first indented portion 101 formed at the output side surface of the control electrode 32 and a first electron beam passing hole portion 102 formed in the first indented portion 101. The first electron beam passing hole 100 can be referred to as a first hole region 100.

Here, the first indented portion 101 can be formed to have a vertically elongated rectangular or oval shape having a horizontal width W2 narrower than a vertical width W1. The first electron beam passing hole portion 102 may be formed to have a circular shape, a rectangular shape as shown in FIG. 4, or a square shape as shown in FIG. 5 in which a vertical width W3 is the same as a horizontal width W4.

Preferably, the vertical width W3 of the first electron beam passing hole portion 102 is formed to be less than the vertical width W1 of the first indented portion 101. Also, the vertical width W4 of the first electron beam passing hole portion 102 is formed to be less than or the same as the horizontal width W2 of the first indented portion 101. According to the experiments by the present inventor, when the ratio of the vertical width W1 to the horizontal width W2 of the first indented portion 101 is set to be 1:1.2 to 1:1.7. The ratio of the vertical width W3 to the horizontal width W4 of the first electron beam passing hole portion 102 is set to be 1:2 to 1:1.5, the focus property is enhanced and generation of moiré is minimized.

In accordance with the principles of the present invention, the control electrode has at least one hole region 100, and the hole region 100 can be a vertically elongated oval shape or a vertically elongated rectangular shape. An indented portion 101 is part of the hole region 100. The indented portion 101 can be a vertically elongated oval shape or a vertically elongated rectangular shape. A hole 102 is part of the hole region 100. The hole 102 can be a circular shape, a vertically elongated oval shape, or a vertically elongated rectangular shape.

In accordance with the principles of the present invention, the control electrode has at least one hole region 110, and the hole region 110 can be a circular shape, a vertically elongated oval shape, or a vertically elongated rectangular shape. The hole region 110 can have no indented portion (as shown in FIG. 3), or the hole region 110 can have an indented portion 111 (as shown in FIG. 5). The indented region 111 can be a circular shape, a vertically elongated oval shape, or a vertically elongated rectangular shape. A hole 112 is part of the hole region 110 shown in FIG. 5. The hole 112 can be a circular shape, a vertically elongated oval shape, or a vertically elongated rectangular shape.

The screen electrode 33 has a plate shape and a second electron beam passing hole 110 is formed to be coaxial with the corresponding cathode 31 and the first electron beam passing hole portion 102. The second electron beam passing hole 110 can be formed to have a circular shape, as shown in FIG. 3. The second electron beam passing hole 110 can be formed to have a vertically elongated rectangular shape like a second electron beam passing hole 110' in FIG. 4. As shown in FIG. 5, the second electron beam passing hole 110 can be formed to include a second indented portion 111 formed at the output side surface of the screen electrode 33 and a second electron beam passing hole portion 112 formed in the second indented portion 111. The second electron beam passing hole 110 can be referred to as a second hole region 110, as shown in FIG. 5.

The shape of the electron beam passing hole formed at the screen electrode 33 is not limited to the above description and may be formed in various shapes to change the profile of the electron beam. Electron beam passing holes for forming an electron lens and a quadrupole lens are formed at the focusing electrodes other than a focusing electrode corresponding to the screen electrode.

In the electron gun having the above structure, when the electron emission portion 31*a* is heated by the heater 31*b* of the cathode 31, an electron beam is emitted from the cathode 31. The electron beam is strongly focused in the horizontal direction and relatively weakly focused in the vertical direction as it passes through a negative lens formed by the electron beam passing holes between the control electrode 32 and the screen electrode 33. That is, since the vertically elongated first indented portion 101 is formed at the output side surface of the control electrode 32 and the circular or rectangular first electron beam passing hole portion 102 is formed in the first indented portion 101, the negative lens formed therebetween has a weak focusing force in the vertical direction while having a strong focusing force in the horizontal direction. Thus, the electron beam passing through the negative lens is strongly focused in the horizontal direction so that the crossover point corresponding to the point of an object of the electron beam is disposed near to the cathode. A vertical component of the electron beam passing through the electron lens is weakly focused so that the crossover point in the vertical direction is disposed far from the cathode 31. Thus, the density of current of the electron beam emitted from the electron emission portion is higher in the horizontal direction than in the vertical direction.

As described above, the electron beam passing through the negative lens passes through a beam forming lens formed between the screen electrode 33 and the control electrode 32. The electron beam in the horizontal direction which passes the negative lens is strongly focused because an incident angle of the pre-focus lens increases, while the electron beam in the vertical direction is weakly focused because the incident angle of the pre-focus lens decreases. In particular, when the vertically elongated second electron beam passing hole 110 is formed at the screen electrode 33 or the second electron beam passing hole 110 is formed of the first indented portion 111 and the second electron beam passing hole portion 112, a focusing force in the horizontal direction can be strengthened to some degree.

Since the point of an object in the horizontal direction of the electron beam is adjusted by using the first indented portion and the first electron beam passing hole, a moiré phenomenon can be minimized while a horizontal and vertical focus property of the electron beam can be improved.

Figure 6:
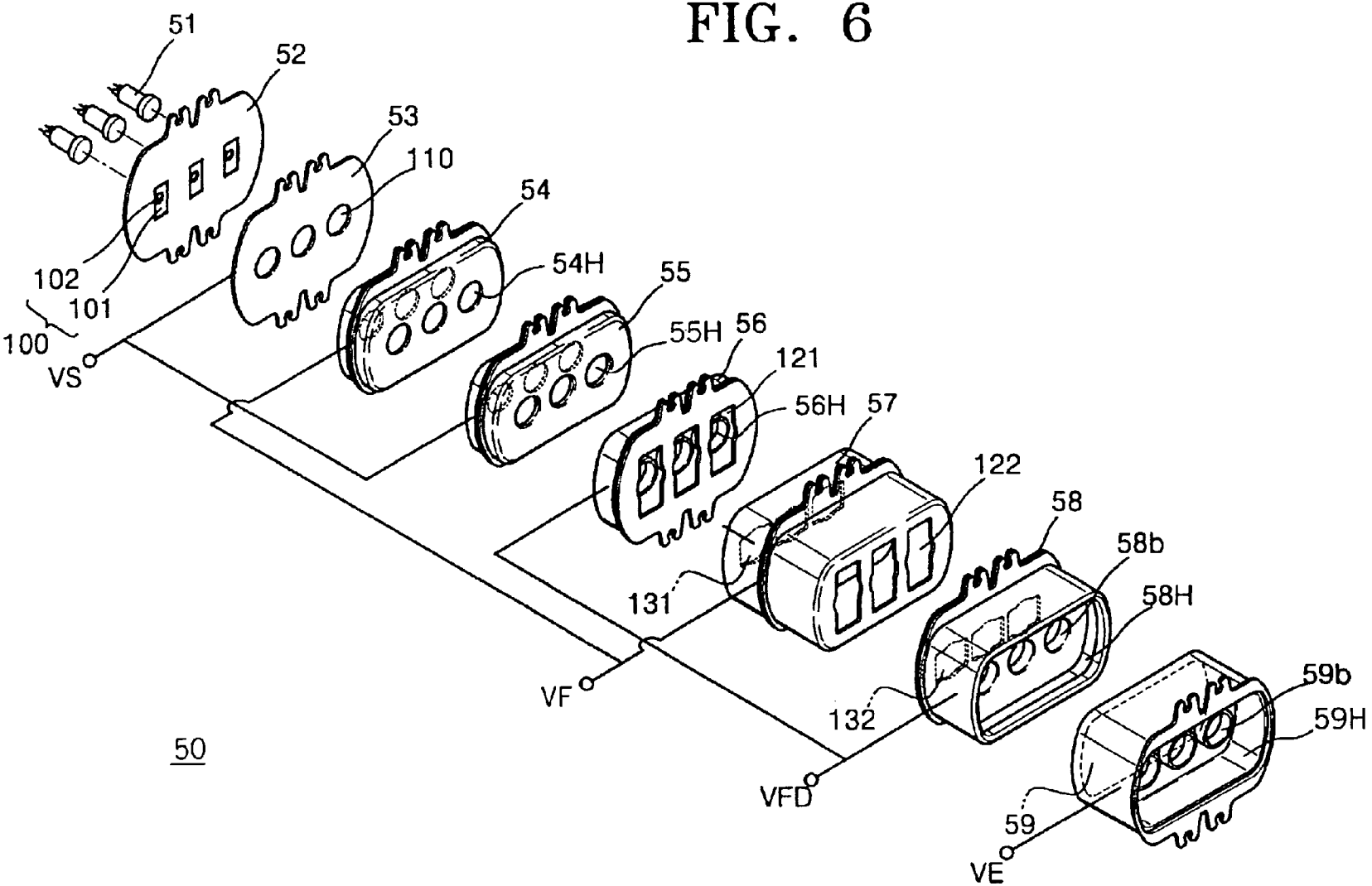
FIG. 6 is an exploded perspective view showing an electron gun for a cathode ray tube, in which the application of voltages is shown, in accordance with the principles of the present invention.

FIG. 6 is an exploded perspective view showing an electron gun for a cathode ray tube, in which the application of voltages is shown, in accordance with the principles of the present invention. As shown in the drawing, the electron gun includes a cathode 51, a control electrode 52, and a screen electrode 53 which form a triode portion, first, second, third, fourth, and fifth focusing electrodes 54, 55, 56, 57, 58 which form an auxiliary lens and a focusing lens for focusing and accelerating an electron beam, and a final acceleration electrode 59 installed adjacent to the fifth focusing electrode 58 and forming a main lens.

The structures of the cathode 51 and the electron beam passing holes formed at the control electrode 52 and the screen electrode 53, forming the triode portion, are the same as those in the above-described preferred embodiments. That is, in the control electrode 52, the first electron beam passing hole 100 includes a first indented portion 101 formed at the output side surface of the control electrode 52 and the electron beam passing hole portion 102 formed at the first indented portion 101. The second electron beam passing hole 110 of the screen electrode 53 has a circular shape, a square shape having the same horizontal and vertical widths, or a vertically elongated rectangular shape.

Electron beam passing holes for forming auxiliary lenses including a quadrupole lens are formed at each of the first, second, third, fourth, and fifth focusing lenses 54, 55, 56, 57, and 58. In detail, circular electron beam passing holes 54H, 55H, and 56H are formed at the first and second focusing electrodes 54 and 55 and at the input side surface of the third focusing electrode 56, respectively. First and second vertically elongated electron beam passing holes 121 and 122 are formed at the output side surfaces of the third and fourth focusing electrodes 56 and 57, respectively. First and second horizontally elongated electron beam passing holes 131 and 132 are formed at the input side surfaces of the fourth and fifth focusing electrodes 57 and 58, respectively. The first and second vertically elongated electron beam passing holes 121 and 122 and the first and second horizontally elongated electron beam passing holes 131 and 132 may have a rectangular, oval, or keyhole shape. However, the shape of the electron beam passing holes is not limited thereto and may be modified to have a variety of shapes, preferably in consideration of assembly of an electron gun.

Large diametric electron beam passing holes 58H and 59H through which three electron beams pass are formed at the output side surface of the fifth focus electrode 58 and the input side surface of the final acceleration electrode 59, forming the main lens, respectively. Three independent small diametric electron beam passing holes 58*b* and three independent small diametric electron beam passing holes 59*a* are formed at positions which are deeper than the large diametric electron beam passing holes 58H and 59H by a predetermined depth, respectively. Here, it is obvious that the independent small diametric electron beam passing holes can be modified into a variety of shapes according to the state of formation for the focus of an electron beam.

In the above preferred embodiment, the number and arrangement of the focusing electrodes for forming the auxiliary lens and main lens are not limited to the above preferred embodiment and a variety of modifications can be possible according to a property of a lens for focusing and diverging the electron beam.

In each of the electron guns having the above structures, a predetermined electric potential is applied to each of the electrodes. The relation of the application of a voltage is described as follows.

A constant voltage VS is applied to the screen electrode 53 and the second focusing electrode 55. A focusing voltage VF higher than the constant voltage VS is applied to the first and fourth focusing electrodes 54 and 57. A dynamic focusing voltage VFD having the focusing voltage VF as a base voltage and synchronized with the deflection yoke is applied to the third and fifth focusing electrodes 56 and 58. An anode voltage VE which is higher than the focusing voltage VF is applied to the final acceleration electrode 59. The state of application of the voltages can be varied according to the state of formation of the electron lens by the electrodes forming the electron gun.

The operation of the electron gun for a color cathode ray tube having the above structure according to the present invention is described with reference to FIG. 6.

When a predetermined voltage is applied to each of the electrodes forming the electron gun 50, a negative lens is formed between the control electrode 52 and the screen electrode 53. Since the first electron beam passing hole 100 including the first indented portion 101 and the first electron beam passing hole portion 102 is formed at the control electrode 52 and a circular or vertically elongated electron beam passing hole is formed at the screen electrode 53 facing the control electrode 52, the negative lens has a relatively weak focusing force in the vertical direction and a relatively strong focusing force in the horizontal direction.

An auxiliary lens is formed between the first, second, and third focusing lenses 54, 55, and 56. First and second quadrupole lenses are formed between the third and fourth focusing lenses 56 and 57 and between the fourth and fifth focusing electrodes 57 and 58, respectively, according to the deflection of the electron beam. A main lens for finally-focusing and accelerating the electron beam is formed between the fifth focusing electrode 58 and the final acceleration electrode 59. The first and second quadrupole lenses can increase or decrease a difference between focusing and diverging forces in the vertical and horizontal directions by the vertically elongated electron beam passing hole and the horizontally elongated electron beam passing hole.

Thus, the electron beam emitted from the cathode 51 is focused and accelerated while passing through the electron lenses formed between the respective electrodes, deflected by the deflection yoke, and lands on the fluorescent film to excite fluorescent substance. In this process, while passing through the negative lens, the electron beam emitted from the cathode 51 receives a strong focusing force in the horizontal direction and relatively weak focusing force in the vertical direction, so that the profile of the electron beam has a vertically elongated shape. In particular, the crossover point of the electron beam in the vertical direction emitted from the cathode 51 is disposed far away from the cathode 51, whereas the crossover point of the electron beam in the horizontal direction is disposed near to the cathode 51 compared to the electron beam in the vertical direction.

As the electron beam in the vertical direction of the electron beam focused by the negative lens passes through the pre-focus lens, an incident angle with respect to the pre-focus lens is relatively reduced and the crossover point of the electron beam in the horizontal direction is disposed near to the cathode 51, so that the incident angle of the electron beam in the horizontal direction with respect to the pre-focus lens relatively increases.

When being deflected toward the periphery of the fluorescent film, the electron beam a passing through the pre-focus lens passes through the first and second quadrupole lenses formed as the dynamic focus voltage is applied to the third and fourth focusing electrodes 56 and 57. Thus, lowering of a focus property according to the focal distance according to a geometrical curvature of a screen surface can be prevented.

As described above, in the electron gun for a color cathode ray tube according to the present invention, by changing the shape of the electron beam passing holes of the control electrode and the screen electrode forming the triode portion, the position of the crossover point which is an imaginary point of an object of the electron beam so that distortion of the electron beam due to irregular magnetic field of the deflection yoke can be minimized and dispersion of an mage by the electron beam landing on the fluorescent surface can be red-aced. Also, by changing the position of the crossover point of the electron beam in the horizontal direction and the vertical direction, a moiré phenomenon at the low resolution can be reduced and simultaneously the resolution at the normal current can be improved.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. An electron gun for a color cathode ray tube, the electron gun comprising:

a cathode emitting an electron beam;

a control electrode having first hole regions, each one of the first hole regions including a first vertically elongated indented portion formed at an output side surface of said control electrode and including a first hole portion formed in the first vertically elongated indented portion, the electron beam passing through said control electrode, the first hole portion having an elongated shape;

a screen electrode installed adjacent to said control electrode, said screen electrode having second hole regions; and a plurality of focusing electrodes sequentially installed from said screen electrode, said plurality of focusing electrodes including a final acceleration electrode forming a main lens of the electron gun.

2. The electron gun of claim 1, the first hole portion with the elongated shape corresponding to a first hole portion having a rectangular shape.

3. The electron gun of claim 1, each one of the second hole regions having one shape selected from among circular and vertically elongated.

4. The electron gun of claim 1, the first vertically elongated indented portion being rectangular.

5. The electron gun of claim 4, the first hole portion with the elongated shape corresponding to a first hole portion having a rectangular shape.

6. The electron gun of claim 4, the first hole portion with the elongated shape having a vertical width and a horizontal width with the vertical width being greater than the horizontal width.

7. The electron gun of claim 6, each one of the second hole regions having one shape selected from among circular and vertically elongated.

8. An electron gun for a color cathode ray tube, the electron gun, comprising:

a cathode emitting an electron beam;

a control electrode having first hole regions, each one of the first hole regions including a first vertically elongated indented portion formed at an output side surface of said control electrode and including a first hole portion formed in the first vertically elongated indented portion, the electron beam passing through said control electrode;

a screen electrode installed adjacent to said control electrode, said screen electrode having second hole regions; and a plurality of focusing electrodes sequentially installed from said screen electrode;

each one of the second hole regions including a second indented portion formed at an output side surface of said screen electrode and a second hole portion formed in the second indented portion, the electron beam passing through the second hole portion.

9. The electron gun of claim 8, the second indented portion having one shape selected from among circular and vertically elongated.

10. The electron gun of claim 9, the second hole portion having one shape selected from among circular and vertically elongated, the circular second hole portion having vertical and horizontal widths equal to each other, the vertically elongated second hole portion having a vertical width greater than a horizontal width.

11. An electron gun for a color cathode ray tube, the electron gun comprising:

a cathode emitting an electron beam;

a control electrode having first hole regions, each one of the first hole regions including a first vertically elongated indented portion formed at an output side surface of said control electrode and including a first hole portion formed in the first vertically elongated indented portion, the electron beam passing through said control electrode;

a screen electrode installed adjacent to said control electrode, said screen electrode having second hole regions; and a plurality of focusing electrodes sequentially installed from said screen electrode, each one of the second hole regions including a second indented portion formed at an output side surface of said screen electrode and a second hole portion formed in the second indented portion, the electron beam passing through the second hole portion.

12. The electron gun of claim 11, the second hole portion having one shape selected from among circular and vertically elongated, the circular second hole portion having vertical and horizontal widths equal to each other, the vertically elongated second hole portion having a vertical width greater than a horizontal width.

13. An electron gun for a color cathode ray tube, the electron gun comprising:

a cathode emitting an electron beam;

a control electrode having first hole regions, each one of the first hole regions including a first vertically elongated indented portion formed at an output side surface of said control electrode and including a first hole portion formed in the first vertically elongated indented portion, the electron beam passing through said control electrode, the first hole portion having one shape selected from among elongated and square;

a screen electrode installed adjacent to said control electrode, said screen electrode having second hole regions; and a plurality of focusing electrodes forming a plurality of quadrupole lenses, said focusing electrodes being sequentially installed from said screen electrode and respectively forming electron beam passing holes having a predetermined shape.

14. An electron gun for a color cathode ray tube, the electron gun comprising:

a cathode emitting an electron beam;

a control electrode having first hole regions, each one of the first hole regions including a first vertically elongated indented portion formed at an output side surface of said control electrode and including a first hole portion formed in the first vertically elongated indented portion, the electron beam passing through said control electrode;

a screen electrode installed adjacent to said control electrode, said screen electrode having second hole regions; and a plurality of focusing electrodes forming a plurality of quadrupole lenses, said focusing electrodes being sequentially installed from said screen electrode and respectively forming electron beam passing holes having a predetermined shape, said focusing electrodes comprising:

first, second, and third focusing electrodes, respectively having electron beam passing holes forming a predetermined shape;

a fourth focusing electrode installed adjacent to said third focusing electrode, said fourth focusing electrode forming a first quadrupole lens; and a fifth focusing electrode installed adjacent to said fourth focusing electrode, said fifth focusing electrode forming a second quadrupole lens.

15. The electron gun of claim 14, further comprising a final acceleration electrode installed adjacent to said fifth focusing electrode, said final acceleration electrode forming a main lens.

16. The electron gun of claim 15, said third and fourth focusing electrodes each having output side surfaces forming vertically elongated electron beam passing holes, said fourth and fifth focusing electrodes each having input side surfaces forming horizontally elongated electron beam passing holes, a constant voltage being applied to said screen electrode and said second focusing electrode, a focusing voltage higher than the constant voltage being applied to said first focusing electrode and said fourth focusing electrode, a dynamic focusing voltage using the focusing voltage as a base voltage being applied to said third and fifth focusing electrodes.

17. The electron gun of claim 16, each one of the second hole regions including a second indented portion formed at an output side surface of said screen electrode and a second hole portion formed in the second indented portion, the electron beam passing through the second hole portion.

18. An electron gun for a color cathode ray tube, the electron gun comprising:

a cathode emitting an electron beam;

a control electrode having first hole regions, each one of the first hole regions including a first vertically elongated indented portion formed at an output side surface of said control electrode and including a first hole portion formed in the first vertically elongated indented portion, the electron beam passing through said control electrode, the first hole portion having a square shape;

a screen electrode installed adjacent to said control electrode, said screen electrode having second hole regions; and a plurality of focusing electrodes sequentially installed from said screen electrode, said plurality of focusing electrodes including a final acceleration electrode forming a main lens of the electron gun.

19. An electron gun for a color cathode ray tube, the electron gun comprising:

a cathode emitting an electron beam;

a control electrode having first hole regions, each one of the first hole regions including a first elongated indented portion formed at an output side surface of said control electrode and including a first hole portion formed in the first elongated indented portion, the electron beam passing through said control electrode;

a screen electrode installed adjacent to said control electrode, said screen electrode having second hole regions; and a first plurality of focusing electrodes forming a plurality of quadrupole lenses, said first plurality of focusing electrodes being sequentially installed from said screen electrode and respectively forming electron beam passing holes, said first plurality of focusing electrodes comprising:

a second plurality of focusing electrodes, respectively having electron beam passing holes;

an additional focusing electrode installed adjacent to said second plurality of focusing electrodes, said additional focusing electrode forming a first quadrupole lens; and a next focusing electrode installed adjacent to said additional focusing electrode, said next focusing electrode forming a second quadrupole lens.

20. An apparatus emitting electron beams, the apparatus comprising:

at least two cathodes emitting electron beams, said at least two cathodes being arranged substantially in a horizontal line;

a control electrode having first hole regions, each one of the first hole regions including a first vertically elongated indented portion formed at an output side surface of said control electrode and including a first hole portion formed in the first vertically elongated indented portion, at least one of the electron beams passing through said control electrode; and a screen electrode installed adjacent to said control electrode, said screen electrode having second hole regions, each one of the second hole regions including a second indented portion formed at an output side surface of said screen electrode and a second hole portion formed in the second indented portion, at least one of the electron beams passing through the second hole portion.

* * * * *